US008685115B2

(12) United States Patent
Nakiboglu

(10) Patent No.: US 8,685,115 B2
(45) Date of Patent: Apr. 1, 2014

(54) DYE METHOD IN APPLICATION OF THE ART OF MARBLING TO CARPETS

(75) Inventor: Taner Nakiboglu, Gaziantep (TR)

(73) Assignee: Royal Hali Iplik Tekstil Mobilya Sanayi Ve Ticaret Snonim Sirketi, Baspinar, Gaziantep (TR)

( * ) Notice: Subject to any disclaimer, the term of this patent is extended or adjusted under 35 U.S.C. 154(b) by 0 days.

(21) Appl. No.: 14/000,852

(22) PCT Filed: Nov. 29, 2011

(86) PCT No.: PCT/TR2011/000227

§ 371 (c)(1),
(2), (4) Date: Aug. 21, 2013

(87) PCT Pub. No.: WO2012/115596

PCT Pub. Date: Aug. 30, 2012

(65) Prior Publication Data

US 2013/0326827 A1 Dec. 12, 2013

(30) Foreign Application Priority Data

Feb. 21, 2011 (TR) ..... 2011 01664

(51) Int. Cl.
*D06M 23/00* (2006.01)

(52) U.S. Cl.
USPC ..... 8/494; 8/636

(58) Field of Classification Search
USPC ..... 8/494, 636
See application file for complete search history.

(56) References Cited

U.S. PATENT DOCUMENTS

| | | | | |
|---|---|---|---|---|
| 1,668,934 | A | 5/1928 | Bracewell | |
| 1,846,845 | A | 2/1932 | Clark | |
| 1,871,920 | A | 9/1932 | Senior | |
| 2,106,634 | A | 1/1938 | Greiser | |
| 4,403,360 | A | 9/1983 | Finney et al. | |
| 5,497,524 | A | 3/1996 | Fleissner | |
| 2004/0133997 | A1 * | 7/2004 | Kelly et al. | 8/549 |

* cited by examiner

*Primary Examiner* — Eisa Elhilo
(74) *Attorney, Agent, or Firm* — Bryant J. Keller; Kirton McConkie

(57) ABSTRACT

The invention relates to a dye method in application of a pattern formed in conformity with the art of marbling to the carpet woven with undyed (ecru) yarn. In this developed method, the object is to allow the dyes to adhere to the yarn fibers of the carpets woven with undyed yarn.

20 Claims, No Drawings

DYE METHOD IN APPLICATION OF THE ART OF MARBLING TO CARPETS

The invention is related to a method designed for easy and fine dyeing of a carpet woven with undyed yarn through impregnation of a pattern, on fibers of the carpet, formed on the condensed water in conformity with the art of marbling.

In the current state of the art, patterning of a carpet is carried out by means of weaving of the carpet with pre-dyed colored yarns and with suitable colors complying with the desired pattern. Dyeing of the yarns is performed through traditional acrylic dyeing process.

In the traditional acrylic dyeing process, depending on its tonnage the chopped fiber is filled into a so-called aqueous press machine, accompanied with 90° C. water, is subjected to pressing and during the pressing process excess bleeding water is rinsed off. The trays filled with fiber is placed into dye kiers. At 70° C., the chemicals intended to be used, acid and dye are introduced into the kier. The dye kiers are sealed off. Starting from 70° C., the temperature of the kier is increased up to 80° C. with gradual increase of 0.5° C. per minute. It is kept at 80° C. for 10 minutes, and then the temperature is increased up to 85° C. with gradual increase of 0.3° C. per minute. It is kept at this temperature for 10 minutes, and then the temperature is increased up to 95° C. with gradual increase of 0.3° C. per minute. It is kept at 95° C. for 10 minutes. If the color is light, the temperature is increased up to 100° C. with gradual increase of 0.3° C. per minute and it is kept at this temperature for 30 minutes. If the color is deep, the temperature is increased up to 104° C. with gradual increase of 0.3° C. per minute and it is kept at 104° C. for an hour.

After the retention process, the temperature of the kier is decreased by 2° C. per minute and is cooled at 70° C. During the cooling of the kier, once it is reached at 85° C., 2% softener is added depending on the fiber weight (Kg). At 70° C., the kier water is discharged, the kier is opened, and the trays are removed and placed individually under centrifuge. The fiber is squeezed at 700 cycles for 15 minutes so that the water ratio of the fiber reaches 5%. This process is merely used in fiber dyeing, but not in carpet dyeing.

The fibers squeezed by means of the centrifuge is dispersed in the blend area for acrylic carpet yarn manufacture. In order for fibers to function effectively, the blending oil and the antistatic chemical agents preventing static electric, mixed with water, are sprayed on and between them. After having been rested for a day, these fibers are formed into tulle through treatment with so-called combing machines. The fibers formed into tulle are separately collected in 8 buckets and introduced into a rebreaker machine. The fiber exiting the mixer machine passes into the fly frame called finisher. In the finisher, the fibers are drawn and detached. Detached fibers are wound on coils in the form of cords.

The cords wound around the coils are attached to the ring machine, and the code and single strand lay of the yarn is adjusted in the ring machine. In this way, the single yarn is produced. The single yarns exiting the ring machine are passed into the folding machine, in which the desired number of the yarn is folded. The yarns exiting the folding machine proceed into the spinning machine, in which the desired strand lay is obtained. The yarn passing through the superba machine is fixed therein, wound on the coil and forwarded to carpet factories for manufacture.

The foregoing details relate to dyeing method of the fiber as well as the method in which the dyed fiber is produced into yarn. As mentioned above, the undyed fiber is produced and used as carpet yarn after it is treated with the carpet yarn manufacturing processes. The undyed carpet yarn is called as ecru yarn and used in carpet manufacturing.

The yarns employed in the traditional acrylic dyeing are merely used in fiber and yarn dyeing. These dyed yarns are used in carpet manufacturing. If the carpet is to be dyed only after it is manufactured, these yarns are not used whereas merely ecru yarns are employed. A carpet woven with ecru yarns cannot be dyed by means of the aforementioned traditional acrylic dyeing process.

Turkish Patent Application No. 2010/07578 is directed to a method for patterning of a carpet woven with undyed yarn. According to this method, in order to transfer the pattern generated on the water mixed with gum tragacanth or carragheen onto a carpet, the fluffs of the carpet are dipped into the pot so they line up with water and the dyes are absorbed by these fluffs. It is herein objected to have the dye impregnated into the carpet.

It is an object of the present invention to particularly increase dye quality while enabling that the carpet woven with undyed yarn is dyed. The method designed with the aim of providing best quality dyeing and effective absorption of the dye through carpet yarns will be detailed hereafter.

1. Clearing and Drying of the Carpet Followed by Dyeing the Same a) Prewash:

The carpet is prewashed with cold water for 15 minutes. The reason why prewashing is applied is to remove from the carpet the chemicals utilized in the yarn and carpet manufacturing during this prewashing process. Unless the chemicals on the carpet are removed, the dyes used during the dyeing of the carpet will not attach to the fibers on the yarns and will cause them to slide. The reason for cold water prewashing is to prevent deformation of the carpet.

b) Mordanting:

The term known as tawing in Turkish has been often used in yarn dyeing area for a long period of time. Such a process applied merely on carpet is for the first time carried out in this study. Mordanting is the second step in cleaning of the chemicals resting on the carpet yarns. Still, the aim is to provide a medium so that dyes adhere to the fibers present on the yarn. In this study, 25-65 gr. of alum (alumina) is added into 1 liter of water and dissolved. This 25-65 gr. alum used in the mordanting process means that the amount of alum is utilized depending on the yarn type of the carpet. The carpet yarns may be acrylic, wool, polyamide, cane or the like. Mordanting is to dissolve the alum in water followed by soaking the carpet evenly and spread into this solution. It is necessary that water thoroughly covers the carpet. The carpet is kept in this condition for 4 to 12 hours. It is required that the pH of the solution is 3. In other words, the solution is acidic. As a result of this characteristic, it will also remove the chemicals resting on the carpet yarns after prewashing.

c) Drying:

The tawed carpets are left for drying in nature. In other words, the carpets are hung up a place where they contact with air. This means that the oxygen in the air contacts with alum and undergoes oxidation reaction. The drying process is implemented for a long period of time such as 2-3 days for better reaction processing. This period varies according to summer and winter conditions. Considering the fact that the carpet may dry in a longer period of time due to the cold weather in winter, the drying period may last long.

2. Formation of the Pattern on Water in Conformity with the Art of Marbling a) Concentration of the Water:

Gum tragacanth and carragheen is used as condensing agents in the art of marbling. The concentration of the water results from the requirement to allow the dye to remain floating on the water. Gum tragacanth or carragheen (a seaweed called carragheen) is used as condensing agents. In order to prepare the condensed water, 50 gr. gum tragacanth or 85 gr. carragheen is added to 7 liters of water. The dissolution of gum tragacanth and carragheen in water takes place in 2-3 days. The ratios of gum tragacanth and carragheen mentioned above differ from those employed in the traditional art of marbling. These ratios are the most suitable ones for the dye to be retained by the carpet fibers, which are the findings of our studies.

b) Preparation of the Dye:

The dye solution is prepared through dissolution of 10 gr. dye in a 100 ml water. A 200 ml (boiled in order not to go bad) of ox gall is added. The dyes are selected according to the type of the yarn. The yarns may be polyacrylonitrile, wool, polyamide, viscose, polypropylene. The viscosity (fluidity) adjustment of the dyes and addition of the above-cited ox gall shall be determined by the expert depending on the pattern to be applied on the carpet.

c) Formation of the Pattern on the Water:

The dyes are spattered onto the above-mentioned condensed water with a brush or straw and manipulated by the marbler.

3. Transfer to the Carpet of the Pattern Formed on the Water:

After the patterns are appeared, the yarns that are present on the carpet are dipped into the condensed water so as to allow them to absorb the colored water and kept in this condition for 3 minutes. Following the carpet grain adjustment, it is drawn and removed from the reverse side so the condensed water is shed out.

4. Carpet Fixation:

The carpet is introduced into the fixing kier and is subjected to fixation between 80 to 105° C. for 60 minutes. The object of this process is to allow the dyes to adhere to the fibers on the yarns and to increase the fastness levels. The fastnesses are dry friction, wet friction, conditioning and the like. The levels of the fastnesses vary from 1 to 5 according to the grey scale. Level 1 and 2 correspond to bad fastness whereas Level 3 corresponds to medium; Level 4, on the other hand, is good and Level 5 is very good.

5. Washing of the Dyed Carpet:

After taken out from the fixing kier, the carpets are washed with water having a temperature of 50 to 90° C. for 10-20 minutes. The aim of washing the carpets is to remove the condensed water and excess dye over the carpets.

6. Centrifuge:

The carpets are squeezed under centrifuge for 5 minutes. The object of this squeezing is to remove water residue off the carpets.

7. Drying:

The carpets are dried in nature or with hot air spraying.

8. Confection:

The carpets are prepared for sale after overlocking.

The invention claimed is:

1. A dye method for dying a carpet woven with an undyed yarn, the method comprising:

disseminating a prepared dye on a surface of condensed water to form a marbling pattern, impregnating the pattern into the carpet woven with the undyed yarn by dipping the undyed yarn woven in the carpet into the condensed water so that the pattern formed on the condensed water is transferred onto the carpet, wherein the carpet is precleaned before dyeing through prewashing and mordanting and then dried; and following impregnating the pattern into the carpet, fixing the dye to the carpet, and cleaning the carpet.

2. A dye method according to claim 1, wherein the precleaning is performed with cold water.

3. A dye method according to claim 1, wherein during-mordanting, the carpet is kept in acidic water for 4-12 hours, wherein the acidic water comprises 25-65 gr. of alum (alumina) per liter.

4. A dye method according to claims 1, wherein following the mordanting, the carpet is dried naturally in such a way to allow it to contact air.

5. A dye method according to claim 1, wherein the condensed water on which the dye is disseminated comprises at least one of gum tragacanth and carragheen, and wherein the at least one of gum tragacanth and carragheen is allowed to dissolve in the condensed water on which the dye is disseminated for 2-3 days.

6. A dye method according to claim 1, wherein the prepared dye comprises dye at a ratio of 10 gr. dye to 100 ml water, with an addition of 200 ml of ox gall.

7. A dye method according to claim 1, wherein the impregnating the pattern into the carpet woven with the undyed yarn comprises dipping the undyed yarn woven in the carpet into the condensed water for 3 minutes so that the pattern formed on the condensed water is transferred onto the carpet.

8. A dye method according to claims 1, wherein after the impregnating the pattern into the carpet woven with the undyed yarn, a grain of the carpet is adjusted, and the condensed water is extracted.

9. A dye method according to claim 1, wherein the fixing the dye to the carpet comprises keeping the carpet in a fixing kier at a temperature between 80 to 105° C.

10. A dye method according to claim 1, wherein the cleaning of the carpet comprises washing the carpet with water at 50° C. to 90° C. for 10-20 minutes.

11. A dye method according to claim 1, wherein following fixing the dye to the carpet, the method further comprises centrifuging the carpet.

12. A dye method according to claim 1, wherein following mordanting, the carpet is dried naturally in such a way to allow it to contact air over 2-3 days.

13. A dye method according to claim 7, wherein after the impregnating the pattern into the carpet woven with the undyed yarn, a grain of the carpet is adjusted, and the condensed water is extracted.

14. A dye method according to claim 1, wherein following fixing the dye to the carpet, the method further comprises drying the carpet through at least one of drying the carpet naturally in ambient air and drying the carpet with hot air.

15. A dye method according to claim 5, wherein the condensed water comprises an amount selected from 50 gr. of the gum tragacanth and 85 gr. of the carragheen.

16. A dye method for dying a carpet, the method comprising:

providing a woven carpet, wherein the carpet comprises undyed fibers that are woven into the carpet;

using cold water to prewash the carpet woven with undyed fibers;

exposing the carpet to a mordanting process by covering the carpet woven with undyed fibers with an acidic solution comprising alum (alumina);

drying the carpet and allowing the alum to experience an oxidation reaction;

applying a dye solution onto condensed water, wherein the condensed water comprises a condensing agent;

dipping the undyed fibers of the carpet woven with the undyed fibers in the condensed water with the dye to allow for color absorption in the carpet;

fixing the carpet to allow the dye to adhere to the undyed fibers; and removing the condensed water and excess dye from the carpet.

17. A dye method of claim 16, wherein the dye solution comprises dye, water, and ox gall.

18. A dye method of claim 16, wherein the fixing the carpet comprises placing the carpet in a fixing kier and subjecting the carpet to a temperature between 80° C. and 105° C.

19. A dye method of claim 16, wherein the acidic solution comprises between 25 and 64 gr. of alum (alumina) per liter.

20. A dye method of claim 16, wherein the condensing agent comprises at least one of tragacanth and carragheen.

* * * * *